United States Patent [19]

Wallner

[11] Patent Number: 4,733,496

[45] Date of Patent: Mar. 29, 1988

[54] PIVOTING SURFBOARD FIN

[76] Inventor: Peter Wallner, 4 Gross Michel Rd., Kororo, N.S.W. 2450, Australia

[21] Appl. No.: 12,661

[22] Filed: Feb. 6, 1987

[30] Foreign Application Priority Data

Feb. 18, 1986 [AU] Australia ..... PH4644

[51] Int. Cl.[4] ..... A63C 15/06

[52] U.S. Cl. ..... 441/79; 114/133; 114/140; 114/167

[58] Field of Search ..... 114/167, 133, 134, 128, 114/140; 441/79, 74, 68

[56] References Cited

U.S. PATENT DOCUMENTS

| | | | |
|---|---|---|---|
| 2,635,575 | 4/1953 | Carrier | 114/167 |
| 3,080,845 | 3/1963 | Pollak | 114/140 |
| 3,890,661 | 6/1975 | Johnson | 441/79 |
| 4,067,280 | 1/1978 | Serfess | 114/128 |
| 4,077,077 | 3/1978 | Harper | 114/140 X |

*Primary Examiner*—Sherman D. Basinger

[57] ABSTRACT

A novel fin for surfboards and watercraft that includes a pivoting rudder-like section that swings out when a turn is commenced, enhancing the maneuvrability of the surfboard by reducing the resistance of the fin as it moves sidewards through the water in a turn and by redirecting the water flow through the pivoting rudder section in the direction of the turn. A fixed blade attaches to the surfboard and a separate pivoting fin section is joined to the fixed blade by two pivot pins. Protruding from a vertical hole in the top of the pivoting fin section is a spring loaded pin which presses into a channel in the underside of a foil integrated into the underside of the fixed blade mounting section. The channel is deepest in the center of the foil thus the spring loaded pin in travelling back and forth along the channel seeks the deepest portion which tends to align the two fin blade sections. A threaded rod locates in the hole below the spring loaded pin and an externally accessible thumbwheel when rotated moves the threaded rod up or down allowing more or less vertical travel of the spring loaded pin thus enabling adjustment of the movement of the pivoting blade section.

1 Claim, 2 Drawing Figures

PIVOTING SURFBOARD FIN

BACKGROUND OF INVENTION

The present invention concerns fins for surfboards and other surfcraft. Previous designs for hinged fins have included pivoting sections or the use of flexible materials. Generally these have not performed well nor have they included a streamlined means of spring returning the moveable section or provided it with a means of adjustment.

The present invention integrates into a novel fin, a spring returning pivoting section with a means to infinitely adjust the extent of travel allowed.

SUMMARY AND OBJECTS OF THE INVENTION

The general object of the invention is to provide a novel surfcraft fin with a variably pivoting section that decreases resistance to water flow across the fin blade and enhances manoeuvrability via a rudder effect, thus improving the versatility and capabilities of a surfcraft.

Another object is to provide a pivoting fin with an easy means of infinitely adjusting the movement of the pivoting section to include no movement.

Another object is to provide a fin with a spring loading means that realigns the pivoting section with the fin blade when necessary.

In summary the invention comprises a surfboard fin with a fixed blade section being mountable to a surfboard and extending vertically down from said mounting point.

Mounted to the fixed blade section, by two pivot pins, is a pivoting blade section. A spring loaded pin protrudes from a hole in the upper edge of the pivot blade section and pushes into a shallow channel in a shaped foil, perpendicularly integrated in to the underside of the fixed blades mounting section. Means is provided to reduce or increase the vertical travel of the spring loaded pin by a threaded rod, situated lower in the hole, which mates through a centrally threaded, textured thumbwheel which protrudes sufficiently, from a hole through the pivot blade, to be externally manipulated. The channel in the foil which the spring loaded pin travels along varies in depth, thus the spring loaded pin seeks the deeper central part of the foil and tends to align the two blade sections.

DESCRIPTION OF THE PREFERRED EMBODIMENT

Figure 2:
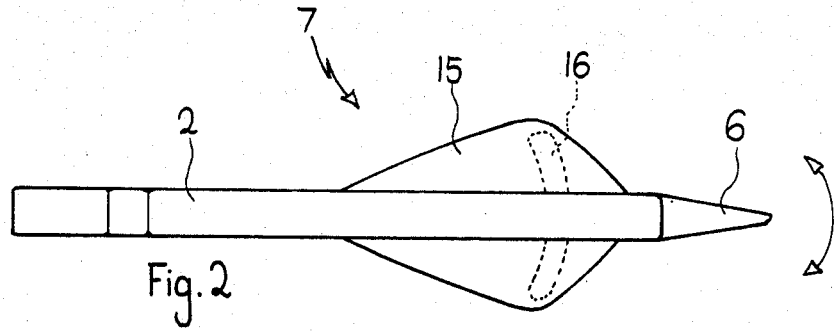
FIG. 2 Is a plan view of the invention as it would sit at rest.
Figure 1:
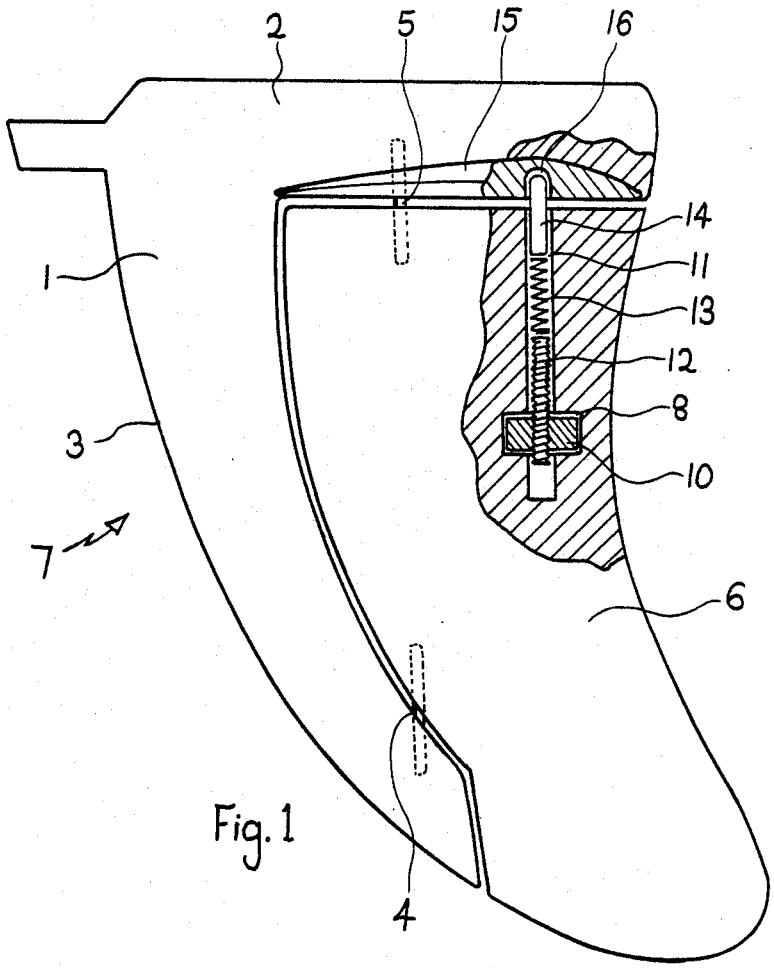
FIG. 1 Is a side elevation of the invention, partially cut away, as it would sit at rest.

The accompanying drawings depict a pivoting surfboard fin 7 comprising a fixed blade 1, with means for conventional attachment to surfboards at horizontal upper 2 and leading edge 3 being symmetrically bevelled to streamline action of said blade.

Pivot pins 4, 5 centrally locate and hinge pivot blade 6 about fixed blade 1. Pivot blade 6 has a horizontal rectangular hole 8 through its thickness, a textured circular thumbwheel 10 with a threaded central hole sits centrally in said rectangular hole. Diameter of thumbwheel 10 is marginally greater than the thickness of pivot blade 6 to enable finger rotation. A circular hole 11, having a diameter less than the thickness of pivot blade 6, extends down vertically from the upper side of pivot blade 6 to pass through the centre of rectangular hole 8. Threaded rod 12 locates in hole 11 mating through the threaded central hole of thumbwheel 10. Compression spring 13 locates freely in hole 11 above threaded rod 12. Pin 14 locates freely in hole 11 on compression spring 13. Upper end of spring pin 14 protrudes from hole 11 contacting suitably shaped channel 16 in shaped foil 15, said foil integrated into the lower surface of fixed blade horizontal upper 2 and extending perpendicular to and symmetrically about fixed blade 1. Channel 16 is shaped to be deepest at the centre of foil 15 and increasingly shallow as it extends to the periphery of said foil.

In the use and operation of the invention, the fixed blade 1 is mounted to the surfboard at the horizontal upper 2 with the leading edge 3 facing the front of the surfboard. Infinite adjustment of the pivot action is made by rotating textured thumbwheel 10 which moves threaded rod 12 up circular hole 11, compressing spring 13 and restricting the vertical travel of pin 14. Fully restricting the vertical travel of pin 14 results in the upper portion of said pin seating in the deeper central portion of channel 16 completely preventing movement of pivot blade 6, and holding pivot blade 6 in alignment with fixed blade 1, counter rotating thumbwheel 10 to allow greater vertical movement of pin 14 results in greater pivot action of pivot blade 6 about pivot pins 4, 5. When a turn is on the surfboard, the rear section of executed pivot blade 6 is subject to increased transverse water resistance until overcoming centering pressure of spring 13 thus swinging pivot blade 6 in the direction of the turn. Water flow along the fin is then further redirected by a rudder effect along the front edge of pivot blade 6. When the turn is countered or the surfboard slows the water flow pressure decreases and the spring return action restores pivot blade 6 into alignment with fixed blade 1.

The preceding embodiment refers to one embodiment only and it is understood that may variations, modifications and other applications may be made.

What is claimed is:

1. A fin for surfboards and other watercraft including the combination of; a fixed leading edge extending vertically down from a horizontal mounting section with an integrated foil, a channel of varying depth in an underside of said foil, a pivotably mounted blade section with a vertical locating hole, a spring loaded pin freely seated in said locating hole protruding sufficiently to contact along said channel, a resilient means to vary and limit the vertical travel of said pin in said locating hole.

* * * * *